United States Patent [19]

Swanson

[11] 4,430,414

[45] Feb. 7, 1984

[54] IMAGE STABILIZERS FOR VESICULAR FILM

[75] Inventor: Jerome E. Swanson, Oakdale, Minn.

[73] Assignee: Minnesota Mining & Manufacturing Company, St. Paul, Minn.

[21] Appl. No.: 440,874

[22] Filed: Nov. 12, 1982

[51] Int. Cl.[3] ..... G03C 1/60; G03C 1/00

[52] U.S. Cl. ..... 430/176; 430/171; 430/177; 430/152; 430/270; 430/290

[58] Field of Search ..... 430/176, 171, 177, 152, 430/290, 270

[56] References Cited

U.S. PATENT DOCUMENTS

| | | | |
|---|---|---|---|
| 2,703,756 | 3/1955 | Herrick | 430/176 |
| 3,408,192 | 10/1968 | Aebi | 430/152 |
| 3,620,743 | 11/1971 | Notley | 96/49 |
| 3,622,336 | 11/1971 | Notley | 96/91 |
| 3,661,589 | 5/1970 | Notley | 96/91 |
| 4,152,156 | 5/1979 | Voisin et al. | 430/152 |

OTHER PUBLICATIONS

Cope; James, "Diazo and Vesicular Microfilm Technologies", J. of Applied Science, vol. 8, No. 5, #190-199, 10/1982.

N. Grassie and E. M. Grant, "Thermal Degration of Poly(α-Chloroacrylonitrile)" Journal of Polymer Science, Part C, No. 16, pp. 591-599, (1967).

*Primary Examiner*—Charles L. Bowers, Jr.

*Attorney, Agent, or Firm*—Donald M. Sell; James A. Smith; David L. Weinstein

[57] ABSTRACT

Stabilizers for vesicular imaging compositions are shown. Derivatives of benzoic acid are used to improve the image stability of vesicular imaging compositions containing homopolymers or copolymers of α-chloroacrylonitrile, and a light-sensitive agent which decomposes and releases gas on irradiation.

14 Claims, No Drawings

IMAGE STABILIZERS FOR VESICULAR FILM

BACKGROUND OF THE INVENTION

The present invention relates to photography and more particularly to the production of vesicular images in water-insensitive photographic materials.

Vesicular images are formed in a photographic film by small bubbles or vesicles of gas which are formed and trapped in the areas of the film exposed to light and which refract light. Generally speaking, the film has a colloid or a resin coating, referred to as a vehicle, on a backing material and a light-sensitive agent, most commonly a diazo compound, dispersed throughout the coating. When the film is selectively exposed to image-defining light, the light-sensitive agent is decomposed and releases molecules of a gas-nitrogen in the case of diazo compounds. The gas ordinarily does not form vesicles immediately, but does so when the film is developed by heating, presumably because the vehicle is relaxed sufficiently on heating for the gas molecules to form bubbles in the vehicle and for the bubbles to expand. The resulting vesicles make the vehicle opaque to transmission of light in the exposed areas and also reflect light and scatter light so that they appear white.

The early vesicular materials employed gelatin as the vehicle. These suffered from the difficulty that the vesicular images faded rapidly. Later work revealed that this problem was caused, in part, by the sensitivity of gelatin to water. Gelatin vehicles absorbed moisture from the atmosphere and became soft, thus collapsing the vesicles and destroying the image.

It is now preferred to employ polymers or resins as the vehicle. Vehicles which are particularly preferred include those described in Notley, U.S. Pat. No. 3,620,743 and Notley, U.S. Pat. No. 3,622,336. U.S. Pat. No. 3,620,743 discloses a vehicle made from a water insoluble polymer selected from a group consisting of homopolymers of α-chloroacrylonitrile and copolymers of α-chloroacrylonitrile with a different vinyl monomer in which the mole fraction of the vinyl monomer in the copolymer is less than 0.50. U.S. Pat. No. 3,622,336 discloses a vehicle which is a copolymer of α-chloroacrylonitrile and α-methacrylonitrile.

It has been shown previously by several investigators that poly(α-chloroacrylonitrile) degrades at high temperatures, e.g. 200° C.–400° C., to give colored conjugated linear and cyclicized polymers. A source for this observation is "Thermal Degradation of Poly(α-Chloroacrylonitrile)", N. Grassie and E. M. Grant, Journal of Polymer Science, No. 16, pp. 591–599 (1967). The mechanism for this degradation involves the loss of HCl at varying rates, and depending upon the temperature, the further loss of HCN. It has also been found that the loss of HCl can occur at much lower temperatures, i.e. 100° C. The cause of loss of HCl at 100° C. is believed to be attributable to the simultaneous presence of a diazonium salt and poly(α-chloroacrylonitrile) resin. Elimination of HCl can take place in a few days at 90° C. and in several hours at 100° C. This degradation has the undesirable effect of bringing about a purple, highly dense background to vesicular film, thus rendering the film unsuitable for imaging.

SUMMARY OF THE INVENTION

This invention involves stabilizers for vesicular imaging compositions. The vesicular-imaging composition which is contemplated by this invention comprises the following components:

(a) a resin vehicle which is essentially a homopolymer of chloroacrylonitrile, or copolymer of chloroacrylonitrile with a different monomer, coated as a thin film on a film support and having intimately dispersed therein (b) a light-sensitive gas-releasing agent, the gas being non-soluble in the resin vehicle, and (c) a stabilizer, said stabilizer being a derivative of benzoic acid.

The stabilizer is particularly suitable for vesicular-imaging compositions employing diazo compounds as the light-sensitive agent. The stabilizer inhibits degradation of films made from homopolymers of α-chloroacrylonitrile and copolymers of α-chloroacrylonitrile with different monomers.

The use of a benzoic acid derivative instead of, or along with, acids previously used or suggested, results in significant improvement in the long-term keeping characteristics of vesicular images formed from vesicular imaging compositions comprising homopolymers or copolymers of α-chloroacrylonitrile.

DETAILED DESCRIPTION

The materials contemplated for the vehicle of the vesicular-imaging composition may be described as a water-insoluble polymer selected from a group consisting of homopolymers of α-chloroacrylonitrile, copolymers of α-chloroacrylonitrile with a different vinyl monomer, and copolymers of α-chloroacrylonitrile and α-methacrylonitrile. Preferably, the mole fraction of the vinyl monomer being used in the α-chloroacrylonitrile/vinyl monomer copolymer is less than about 0.50. The vinyl monomer is preferably chosen from the group consisting of styrene, vinyl toluene, α-methylstyrene, and acrylonitrile. The α-chloroacrylonitrile/α-methacrylonitrile copolymer should have a ratio of chloroacrylonitrile to methacrylonitrile between 1 to 4 and 4 to 1, and it is desirable that the ratio be between 1 to 1 and 1 to 3 and approach 1 to 2.

Although the homopolymers or copolymers of α-chloroacrylonitrile without blending have excellent characteristics, a substantial amount of another polymer which is compatible can be tolerated, generally up to about 50 percent by weight. Polymers which are suitable for blending include cellulose acetate, poly(α-methylstyrene), copolymers of polyvinylidene chloride with acrylonitrile, and polymethylmethacrylate.

The polymerization or copolymerizations to be undertaken to form the vehicle may in general be carried out in solution, in emulsion, or in suspension and generally with the application of catalysts and heat, the details of which do not form part of the present invention. The blending may be done in a common solvent when appropriate, or may be done by mixing compatible solvents.

The light-sensitive agents are characterized by the ability to liberate gas upon irradiation. Light sensitive agents which liberate nitrogen are particularly effective. The preferred light-sensitive agents are diazonium salts.

Suitable light-sensitive agents, as disclosed in U.S. Pat. Nos. 3,032,414 and 3,485,631, include, for example, p-diazo diphenylamine sulfate, p-diazo diethylaniline zinc chloride, p-diazo ethyl hydroxyethylaniline zinc chloride, p-diazo ethyl methyl aniline zinc chloride, p-diazo diethyl methyl aniline zinc chloride, p-diazo ethyl hydroxyethylaniline zinc chloride, 1-diazo-2-oxy naphthaline-4-sulfonate, p-diethyl amino benzene diazonium chloride $ZnCl_2$, 4-benzylamino-2,5-diethoxy benzene diazonium chloride, p-chlorobenzene-sulfonate of 4-diazo-1-cyclohexylaniline, p-chlorobenzene-sulfonate of 4-diazo-2-methoxy-1-cyclohexylamino benzene, tin chloride double salt of 4-N-methylcyclohexyl-aminobenzene diazonium chloride, p-acetamino benzene diazonium chloride, p-dimethylamino benzene diazonium chloride, 3-methyl-4-diethyl amino benzene diazonium chloride, 4-morpholino benzene diazonium chloride, 4-piperidyl-2,5-diethoxy benzene diazonium chloride, 1-dimethyl amino naphthaline-4-diazonium chloride, 4-phenyl amino diazo benzene diazonium chloride. Other materials such as o-quinone diazides, which are well known in the art as "diazo oxides", are also quite suitable as light-sensitive, nitrogen gas-generating agents.

The stabilizer is a derivative of benzoic acid. Derivatives of benzoic acid which are useful as stabilizers include o-hydroxybenzoic acid (salicylic acid) and derivatives thereof, and p-sulfobenzoic acid and derivatives thereof. The term "derivative", as used herein, means an organic compound containing a structural radical similar to that from which it is derived. More particularly, the term "benzoic acid derivative" refers to such compounds as a benzoic acid containing substituents on the aryl group, such as, for example, hydroxy-, halo-, sulfo-, alkyl having 1 to 8 carbon atoms, and phenyl groups. The preferred stabilizer is 5-sulfosalicylic acid. Other particular stabilizers within the group of benzoic acid derivatives include p-sulfobenzoic acid monopotassium salt and 5-chlorosalicylic acid.

The film support can be any suitable material. If the image-bearing record is to be used as a transparency then a polyester such as polyethylene terephthalate, glass, polyethylene, or polypropylene may be used directly. Cellulose acetate may be used if it is coated with an interlayer to prevent diffusion of plasticizer from the support into the vesicular image-bearing layer. A polycarbonate such as "Lexan" or oriented polystyrene may be used if there is an interlayer to prevent attack on the support by solvents used in the coating. Opaque support material may be used where the image is to be viewed by reflection and should be dark in color or black for maximum contrast with the developed vesicles which appear white in reflection. Such materials include metal foil, pigmented plastics, or paper.

The vehicle is prepared by mixing the homopolymer or copolymer of α-chloroacrylonitrile with a blending resin in a suitable solvent. The preferred blending resins include copolymers of vinylidenechloride with acrylonitrile, and poly(vinylidene chloride). The preferred solvent is methyl ethyl ketone. The light-sensitive agent and the stabilizer, i.e. the benzoic acid derivative, are premixed, preferably with an agent that prevents premature gelling of the imaging composition. Methanol is the preferred gellation inhibitor. To the mixture containing the light-sensitive agent and stabilizer is added the vehicle mixture, and any other additives which may be desired. For example, certain dyes and speed enhancers can be added at this point. The addition of inert light absorbing dyes will enhance the vesicular image contrast with only a relatively slight increase in background density. The addition of silicone oil is desirable to enhance the speed of the film.

The amount of light-sensitive agent in the composition should range from about 5.0 to about 20.0 percent, based on the weight of the vehicle. The preferred amount is about 10.0 to about 16.0 percent, based on the weight of the vehicle. The amount of stabilizer in the composition should range from about 4.0 to about 16.0 percent, based on the dry weight of the vehicle, with the preferred amount being between about 6.4 and about 8.8 percent.

Too high a concentration of the derivative of benzoic acid may result in gelling of the imaging composition. Addition of about 47 to about 175 weight percent methanol and about 0.40 to about 1.6 weight percent thiourea, based on the dry weight of the vehicle, prevents gellation of the composition. A higher concentration of thiourea results in increased tendency toward purpling. Other factors which influence gellation are age and purity of the diazonium salt, purity of the solvent used for the chloroacrylonitrile homopolymer or copolymer, and molecular weight of the polymer.

The coating solution can be applied to the support material by any conventional coating technique. Gravure, reverse roll, and extrusion bar coating operations are preferred. A sufficient amount of coating material should be applied to give a dried film between about 2 and about 100 micrometers in thickness. The time and temperature of drying should be adjusted to secure essentially complete removal of solvent and to suppress any tendency of the film coating to blister on subsequent application of the development temperature, and to avoid excessive thermal decomposition of the light-sensitive agent. Typical drying temperatures are generally between 70° C. and 170° C.

In order to measure the optical density of samples prepared from the vesicular film of the present invention, the following formula was employed:

$$D = \log_{10} O = \log_{10} \frac{100}{\% T} = \log_{10} \frac{(\phi z)}{(\phi i)}$$

where

D=Optical Density
O=Opacity
%T=Percent Transmittance
$\phi i$=Transmitted light
$\phi z$=Incident light In order to test the stability of the vesicular imaging films of this invention, coated samples were cut into strips, exposed through a step wedge to ultraviolet light, and placed in an oven at 100° C. for accelerated aging. All density measurements were made on a MacBeth TD 528 densitometer, manufactured by Kollmorgen Corporation, Newburgh, N. Y., in the projection mode.

The invention can be further illustrated by the following examples:

EXAMPLES 1–18

A vesicular imaging composition was prepared as follows:

A stock solution of the vehicle was prepared by dissolving 150 g of the homopolymer of α-chloroacrylonitrile and 30 g of a copolymer of vinylidenechloride and acrylonitrile (Saran® F-120, manufactured by Dow Chemical Company) in 1320 g of methyl ethyl ketone. The polymers were dissolved with mild agitation.

Methanol, 5-sulfosalicyclic acid, and the diazonium salt were premixed. The amounts of methanol and 5-sulfosalicylic acid used in each example are set forth in Table I. The amount of diazonium salt, 1-diazo-2,5-diethoxy-4-morpholino benzene borofluoride (i.e., tetrafluoroborate), was held constant for each example. This amount was 0.36 g. Vehicle solution, dye, and silicone oil were then added to the premix. The amount of vehicle solution used in each Example is also set forth in Table I. The amount of dye, Acetol Blue RLS, and the amount of silicone oil, was held constant for each Example. These amounts were 0.09 g dye and 1 drop of silicone oil. The clear solution containing the imaging composition was coated by means of a knife coater onto a 4-mil polyethylene terephthalate film support and dried at 230° F. for 2 minutes and 15 seconds to remove residual solvent. Coated samples were exposed through a step wedge to ultraviolet light, and placed in an oven at 100° C. for accelerated aging. The results are set forth in Table I.

TABLE I

| | Ingredient[1] | | | | Optical Density | | | |
|---|---|---|---|---|---|---|---|---|
| | | | 5-Sulfosalicyclic | | 20 hours, 100° C. | | 72 hours, 100° C. | |
| Example | Vehicle (g) | Thiourea (g) | Acid (g) | Methanol (g) | Dmin | Dmax | Dmin | Dmax |
| 1 | 37.8 | 0.02 | 0.15 | 2.2 | 0.32 | 1.77 | 0.84 | 2.03 |
| 2 | 37.8 | 0.06 | 0.15 | 2.2 | 0.64 | 1.57 | 1.32 | 2.34 |
| 3 | 37.8 | 0.02 | 0.40 | 2.2 | 0.16 | 1.80 | 0.16 | 1.88 |
| 4 | 37.8 | 0.06 | 0.40 | 2.2 | 0.16 | 1.88 | 0.16 | 1.85 |
| 5 | 34.2 | 0.02 | 0.15 | 2.2 | 0.34 | 1.80 | 0.80 | 2.18 |
| 6 | 34.2 | 0.06 | 0.15 | 5.8 | 0.74 | 1.89 | 1.55 | 2.68 |
| 7 | 34.2 | 0.02 | 0.40 | 5.8 | 0.15 | 2.10 | 0.15 | 2.12 |
| 8 | 34.2 | 0.06 | 0.40 | 5.8 | 0.15 | 2.11 | 0.15 | 2.15 |
| 9 | 36.0 | 0.04 | 0.30 | 5.8 | 0.16 | 1.93 | 0.17 | 2.06 |
| 10 | 36.0 | 0.04 | 0.30 | 5.8 | 0.16 | 1.71 | 0.15 | 1.68 |
| 11 | 36.0 | 0.04 | 0.30 | 5.8 | 0.16 | 1.86 | 0.16 | 1.87 |
| 12 | 36.0 | 0.04 | 0.30 | 5.8 | 0.15 | 1.78 | 0.15 | 1.29 |
| 13 | 36.0 | 0.006 | 0.30 | 4.0 | 0.15 | 1.86 | 0.15 | 1.90 |
| 14 | 36.0 | 0.09 | 0.30 | 4.0 | 0.20 | 1.22 | 0.42 | 1.14 |
| 15 | 36.0 | 0.40 | 0.05 | 4.0 | 1.57 | 2.41 | 2.12 | 2.71 |
| 16 | 36.0 | 0.04 | 0.55 | 4.0 | 0.14 | 1.70 | 0.13 | 1.48 |
| 17 | 39.0 | 0.04 | 0.30 | 1.0 | 0.16 | 1.84 | 0.15 | 1.77 |
| 18 | 33.0 | 0.04 | 0.30 | 7.0 | 0.15 | 1.60 | 0.15 | 1.71 |

[1]The amount of dye for each example was 0.09 g. The amount of the diazonium salt for each example was 0.36 g. The amount of silicone oil for each example was 1 drop.

From the foregoing table, it can be seen that the most effective stabilization of a developed vesicular image was brought about when the concentration of 5-sulfosalicylic acid ranged from 6.2 to 12.5 weight percent, the concentration of methanol ranged from 50 to 175 weight percent, and the concentration of thiourea ranged from 0.4 to 1.4 weight percent, all of the foregoing concentrations based on the dry weight of the poly-(α-chloroacrylonitrile) vehicle.

EXAMPLES 19–36

A solution was prepared by dissolving 150 g of the copolymer of α-chloroacrylonitrile and methacrylonitrile and 30 g of a copolymer of vinylidene chloride and acrylonitrile (Saran® F-120, manufactured by Dow Chemical Company) in 1220 g of methyl ethyl ketone. The polymers were dissolved with mild agitation.

Methanol, 5-sulfosalicyclic acid, and the diazonium salt were premixed as in Examples 1–18. The vehicle solution, dye and silicone oil were added to the premix as in Examples 1–18. The amount of the vehicle solution and the amount of methanol and 5-sulfosalicyclic acid employed in each example are set forth in Table II. The amount of the diazonium salt, 1-diazo-2,5-diethoxy-4-morpholino benzene borofluoride, was held constant for each example. This amount was 0.36 g. The amount of dye, Acetol Blue RLS, and the amount of silicone oil, was held constant for each example. These amounts were 0.09 g dye and 1 drop of silicone oil.

The clear solution containing the imaging composition was coated by means of a knife coater onto a 4-mil polyethylene terephthalate film support and dried at 230° F. for 2 minutes and 15 seconds to remove residual solvent. Coated samples were exposed through a step wedge to ultraviolet light, and placed in an oven at 100° C. for accelerated aging.

The results are set forth in Table II.

TABLE II

| | Ingredient[1] | | | | Optical Density | | | |
|---|---|---|---|---|---|---|---|---|
| | | | 5-Sulfosalicyclic | | 20 hours, 100° C. | | 60 hours, 100° C. | |
| Example | Vehicle (g) | Thiourea (g) | Acid (g) | Methanol (g) | Dmin | Dmax | Dmin | Dmax |
| 19 | 37.8 | 0.02 | 0.15 | 2.2 | 0.52 | 0.81 | 1.16 | 1.49 |
| 20 | 37.8 | 0.06 | 0.15 | 2.2 | 0.72 | 0.75 | 1.57 | 1.69 |
| 21 | 37.8 | 0.02 | 0.40 | 2.2 | 0.19 | 1.57 | 0.17 | 1.90 |
| 22 | 37.8 | 0.06 | 0.40 | 2.2 | 0.20 | 2.29 | 0.19 | 2.30 |
| 23 | 34.2 | 0.02 | 0.15 | 2.2 | 0.39 | 2.08 | 0.88 | 2.45 |
| 24 | 34.2 | 0.06 | 0.15 | 5.8 | 0.63 | 2.59 | 1.40 | 3.36 |
| 25 | 34.2 | 0.02 | 0.40 | 5.8 | 0.19 | 2.35 | 0.18 | 2.41 |
| 26 | 34.2 | 0.06 | 0.40 | 5.8 | 0.19 | 2.37 | 0.19 | 2.45 |
| 27 | 36.0 | 0.04 | 0.30 | 5.8 | 0.19 | 2.29 | 0.18 | 2.30 |
| 28 | 36.0 | 0.04 | 0.30 | 5.8 | 0.20 | 2.37 | 0.20 | 2.34 |
| 29 | 36.0 | 0.04 | 0.30 | 5.8 | 0.20 | 2.01 | 0.22 | 2.18 |
| 30 | 36.0 | 0.04 | 0.30 | 5.8 | 0.19 | 1.72 | 0.19 | 1.82 |
| 31 | 36.0 | 0.006 | 0.30 | 4.0 | 0.19 | 2.09 | 0.17 | 2.20 |

TABLE II-continued

| Example | Ingredient[1] Vehicle (g) | Thiourea (g) | 5-Sulfosalicyclic Acid (g) | Methanol (g) | Optical Density 20 hours, 100° C. Dmin | Dmax | 60 hours, 100° C. Dmin | Dmax |
|---|---|---|---|---|---|---|---|---|
| 32 | 36.0 | 0.09 | 0.30 | 4.0 | 0.22 | 1.82 | 0.36 | 2.14 |
| 33 | 36.0 | 0.04 | 0.05 | 4.0 | 1.42 | 1.43 | 2.02 | 2.14 |
| 34 | 36.0 | 0.04 | 0.55 | 4.0 | 0.20 | 2.34 | 0.19 | 2.40 |
| 35 | 39.0 | 0.04 | 0.30 | 1.0 | 0.21 | 1.08 | 0.23 | 1.24 |
| 36 | 33.0 | 0.04 | 0.30 | 7.0 | 0.19 | 2.17 | 0.21 | 2.22 |

[1]The amount of dye for each example was 0.09 g. The amount of diazonium salt for each example was 0.36 g. The amount of silicone oil for each example was 1 drop.

From the foregoing table, it can be seen that effective stabilization of a developed vesicular image was brought about when the concentration of 5-sulfosalicylic acid ranged from 5.8 to 12.0 weight percent, the concentration of methanol ranged from 47 to 164 weight percent, and the concentration of thiourea ranged from 0.4 to 1.3 weight percent, all of the foregoing concentrations based on the dry weight of the α-chloroacrylonitrile/methacrylonitrile copolymer vehicle.

EXAMPLES 37–41

This example evaluated the effectiveness of aromatic sulfonic acids as stabilizers for diazonium salt/poly(α-chloroacrylonitrile) vesicular imaging systems.

The following compounds were used as stabilizers for the diazonium salt and poly(α-chloroacrylonitrile) film system:

(1) 5-sulfosalicylic acid
(2) benzene sulfonic acid sodium salt
(3) p-sulfobenzoic acid monopotassium salt
(4) p-chlorobenzene sulfonic acid sodium salt
(5) 5-chlorosalicylic acid The resin premix consisted of the following ingredients:

(1) 2 weight percent polyvinylidene chloride (Saran® F310 from Dow Chemical Company)
(2) 10 weight percent poly(α-chloroacrylonitrile)
(3) 88 weight percent 2-butanone The diazonium salt was 1-diazo-2, 5 diethoxy-4-morpholino benzene borofluoride. The amount of each ingredient used in Examples 37–41 is set forth in the following Table.

TABLE III

| Example | Stabilizer | Ingredient Resin Premix (g) | Methanol (g) | Diazonium Salt (g) | Stabilizer (g) |
|---|---|---|---|---|---|
| 37 | 5-sulfosalicylic acid | 35 | 4 | 0.36 | 0.4 |
| 38 | benzene sulfonic acid sodium salt | 35 | 4 | 0.36 | 0.5 |
| 39 | p-sulfobenzoic acid monopotassium salt | 35 | 4 | 0.36 | 0.5 |
| 40 | p-chlorobenzene sulfonic acid sodium salt | 35 | 4 | 0.36 | 0.5 |
| 41 | 5-chlorosalicylic acid | 35 | — | 0.4 | 0.4 |

The mixtures were aged at 100° C. The following Table sets forth the effect on optical density of the stabilization of the diazonium salt with the various stabilizers.

TABLE IV

| Example | Dmin/Dmax Initial | Dmin/Dmax Aged | Time @ 100° C. |
|---|---|---|---|
| 37 | .09/2.08 | .09/2.16 | 240 hours |
| 38 | .08/2.07 | 2.17/2.36 | 20 hours |
| 39 | .10/2.08 | .19/1.65 | 20 hours |
| 40 | .08/2.04 | 1.94/1.93 | 20 hours |
| 41 | .08/2.12 | .71/3.05 | 64 hours |

From the foregoing table, it can be seen that 5-sulfosalicylic acid is a far better stabilizer than any of the other acids used. However, p-sulfobenzoic acid monopotassium salt and 4-chlorosalicylic acid also provide enhanced stabilization for vesicular images formed from a diazonium salt/poly(α-chloroacrylonitrile) system. The second best alternative, p-sulfobenzoic acid monopotassium salt, resulted in a red background. Benzene sulfonic acid sodium salt and p-chlorobenzene sulfonic acid sodium salt, neither of which are derivatives of benzoic acid, were not suitable as stabilizers.

EXAMPLE 42

This example determines whether the nature of the diazonium salt affects the stabilizing effectiveness of 5-sulfosalicylic acid. The results are compared with those from imaging compositions made with citric acid only.

The diazonium salts which were tested were dissolved in a solution consisting of the following ingredients in the amounts indicated:

| | |
|---|---|
| 5-sulfosalicylic acid | 0.36 g |
| resin premix | 35.0 g |
| 2 weight percent polyvinylidene chloride (Saran® F310 from Dow Chemical Company) | |
| 10 weight percent poly(-chloroacrylonitrile) | |
| 88 weight percent 2-butanone | |
| thiourea | 0.02 g |
| methanol | 5.0 g |

The amount of diazonium salt employed in each test sample was 0.36 g. The films were aged at 100° C.

TABLE V

| Diazonium Salt | Dmin/Dmax Initial | 5-Sulfosalicylic Acid Dmin/Dmax Aged | Time (hrs) | Citric Acid Dmin/Dmax Aged | Time (hrs) |
|---|---|---|---|---|---|
| 1-diazo-2,5-diethoxy-4-morpholino benzene borofluoride | .07/2.08 | .09/2.16 | 240 | 1.06/3.18 | 70 |
| diphenylamine-4-diazonium | .07/1.50 | .10/1.41 | 64 | .11/.79 | 64 |

TABLE V-continued

| Diazonium Salt | Dmin/ Dmax Initial | 5-Sulfosalicylic Acid Dmin/ Dmax Aged | 5-Sulfosalicylic Acid Time (hrs) | Citric Acid Dmin/ Dmax Aged | Citric Acid Time (hrs) |
|---|---|---|---|---|---|
| fluoroborate | | | | | |
| N—(4-diazo-2,5-diethoxyphenyl) morpholine hexafluorophosphate | .06/2.02 | .23/2.24 | 64 | .23/.26 | 24 |
| N—(4-diazo-2-chlorophenyl) pyrollidone hexafluorophosphate | .06/2.02 | .38/2.49 | 64 | .60/.65 | 24 |
| 4-diazo-2,5-dibutoxyphenyl morpholine hexafluorophosphate | .08/2.00 | .07/1.66<br>.43/2.06 | 20<br>120 | .27/.50<br>2.83/2.84 | 20<br>120 |
| N—(4-diazo-2,5-dibutoxyphenyl) morpholine borofluoride | .06/1.94 | .07/1.90 | 64 | .13/2.04<br>.51/2.14 | 44<br>112 |
| 1-diazo-3-methyl-4-pyrrolidino benzene borofluoride | .07/2.05 | .09/2.09 | 68 | .30/2.50<br>1.84/3.92 | 44<br>112 |
| 1-diazo-3-methyl-4-pyrrolidino-benzene zinc chloride | .07/2.01 | .10/1.79 | 68 | .08/1.69<br>.11/.80 | 44<br>112 |
| 1-diazo-2,5-dimethoxy-4 morpholino benzene zinc chloride | .08/2.13 | .09/2.09 | 68 | .20/.21<br>.80/.75 | 44<br>112 |
| 4-diazo-2,5-dimethoxyphenyl morpholine zinc chloride | .07/1.84 | .09/1.91 | 68 | .12/1.19<br>.53/1.42 | 44<br>112 |

The foregoing results indicate that the use of 5-sulfosalicylic acid will result in a significant improvement in image stability for borofluoride and zinc chloride diazonium salts used in the poly(α-chloracrylonitrile) vesicular system. 5-sulfosalicylic acid is also quite useful for systems containing other diazonium salts. It is superior to citric acid as a stabilizer for vesicular imaging systems containing diazonium salts and vehicles made from homopolymers or copolymers of α-chloroacrylonitrile.

What is claimed is:

1. In a vesicular imaging material capable of furnishing a record in the form of a distribution pattern of radiation scattering discontinuities formed within an optically clear thermoplastic hydrophobic film, comprising a homopolymer or copolymer of α-chloroacrylonitrile and a light decomposable material substantially uniformly dispersed therein, said material upon exposure to light decomposing into products which are volatile to form said radiation scattering discontinuities only in the light struck areas in said polymer to furnish thereby said record, the improvement wherein a derivative of benzoic acid is present in an image-stabilizing amount in said material.

2. The material of claim 1 wherein the derivative of benzoic acid is selected from the group consisting of 5-sulfosalicylic acid, 5-chlorosalicylic acid, and p-sulfobenzoic acid monopotassium salt.

3. The material of claim 1 wherein the copolymer is formed from α-chloroacrylonitrile monomer with a different vinyl monomer in which the mole fraction of said different vinyl monomer is less than about 0.50.

4. The material of claim 2 wherein the copolymer is formed from α-chloroacrylonitrile monomer with a different vinyl monomer in which the mole fraction of said different vinyl monomer is less than about 0.50.

5. The material of claim 1 wherein the copolymer is formed from α-chloroacrylonitrile monomer and α-methacrylonitrile monomer.

6. The material of claim 2 wherein the copolymer is formed from α-chloroacrylonitrile monomer and α-methacrylonitrile monomer.

7. A material according to claim 5 wherein said copolymer has a ratio of α-chloroacrylonitrile to α-methacrylonitrile exceeding 1 to 4 but not exceeding 4 to 1.

8. A material according to claim 6 wherein said copolymer has a ratio of α-chloroacrylonitrile to α-methacrylonitrile exceeding 1 to 4 but not exceeding 4 to 1.

9. A material according to claim 1 wherein said light-decomposable material is a photosensitive diazonium compound capable of generating nitrogen upon exposure to radiation.

10. A material according to claim 2 wherein said light-decomposable material is a photosensitive diazonium compound capable of generating nitrogen upon exposure to radiation.

11. The material of claim 1 wherein the derivative of benzoic acid is present in an amount equivalent to from about 4.0 to about 16.0 percent by weight of the dry polymeric component.

12. The material of claim 2 wherein the derivative of benzoic acid is present in an amount equivalent to from about 4.0 to about 16.0 percent by weight of the dry polymeric component.

13. A material according to claim 1 including a second polymeric organic material, said second organic material being chosen from the group consisting of cellulose acetate, poly(α-methylstyrene), copolymers of vinylidene chloride with acrylonitrile, and poly(methylmethacrylate).

14. A material according to claim 2 including a second polymeric organic material, said second organic material being chosen from the group consisting of cellulose acetate, poly(α-methylstyrene), copolymers of vinylidene chloride with acrylonitrile, and poly(methylmethacrylate).

* * * * *